US005154466A

United States Patent [19]

Neuhaus

[11] Patent Number: 5,154,466

[45] Date of Patent: Oct. 13, 1992

[54] PNEUMATIC SOIL REMOVAL TOOL

[75] Inventor: John E. Neuhaus, Newport News, Va.

[73] Assignee: The United States of America as represented by the United States Department of Energy, Washington, D.C.

[21] Appl. No.: 644,646

[22] Filed: Jan. 23, 1991

[51] Int. Cl.[5] ..... A01B 63/00

[52] U.S. Cl. ..... 294/50.9; 294/19.1; 111/106

[58] Field of Search ..... 294/50.9, 1.4, 19.1, 294/49, 50.8, 59, 68.23, 88, 906, 104; 37/DIG. 7, DIG. 9, DIG. 9, DIG. 11, 137-140; 111/101, 106

[56] References Cited

U.S. PATENT DOCUMENTS

| | | | |
|---|---|---|---|
| 2,941,367 | 6/1960 | Schwab | 294/19.1 X |
| 3,246,777 | 4/1966 | Lino | 294/50.9 X |
| 3,606,435 | 9/1971 | Weber | 294/68.23 |
| 4,275,479 | 6/1981 | Korhonen | 294/19.1 X |
| 5,011,206 | 4/1991 | Guironnet | 294/906 X |

FOREIGN PATENT DOCUMENTS

| | | | |
|---|---|---|---|
| 1169064 | 10/1969 | United Kingdom | 294/50.9 |

*Primary Examiner*—Margaret A. Focarino
*Assistant Examiner*—Dean J. Krammer
*Attorney, Agent, or Firm*—Judy K. Kosovich; William R. Moser; Richard E. Constant

[57] ABSTRACT

A soil removal tool is provided for removing radioactive soil, rock and other debris from the bottom of an excavation, while permitting the operator to be located outside of a containment for that excavation. The tool includes a fixed jaw, secured to one end of an elongate pipe, which cooperates with a movable jaw pivotably mounted on the pipe. Movement of the movable jaw is controlled by a pneumatic cylinder mounted on the pipe. The actuator rod of the pneumatic cylinder is connected to a collar which is slidably mounted on the pipe and forms part of the pivotable mounting assembly for the movable jaw. Air is supplied to the pneumatic cylinder through a handle connected to the pipe, under the control of an actuator valve mounted on the handle, to provide movement of the movable jaw.

5 Claims, 1 Drawing Sheet

PNEUMATIC SOIL REMOVAL TOOL

The Government has rights in this invention pursuant to Contract No. DE-ACC11-76PN00014 awarded, etc.

FIELD OF THE INVENTION

The present invention relates to a pneumatically-actuated operator-held soil removal tool and more particularly, to a tool of this type which is particularly adapted for use in removing radioactively contaminated soil while working through a containment, although the tool is also of general applicability in performing excavating operations.

BACKGROUND OF THE INVENTION

The removal of radioactively contaminated soil, rocks and other debris from the bottom of an excavation presents special problems. At present, commercially available digging tools require manual operations to effect such soil removal. In particular, the basic method now used employs a digging tool including a manually operated movable lever which, in turn, operates a movable jaw through the action of a connecting bar. This tool is relatively difficult to use, particularly for deep excavations.

As mentioned above and described in detail below, the present invention involves the provision of a pneumatically-operated tool. Pneumatically operated digging tools are, of course, not new and examples of such tools are disclosed in U.S. Pat. Nos. 3,807,589 (Shovick) and 4,327,509 (Bean). There are also many different digging tools which include a movable jaw which cooperates with a non-movable jaw to provide the digging action. Examples of such tools include those disclosed in U.S. Pat. Nos. 226,118 (Scheidler); 2,140,430 (Lynch); 3,139,299 (Bowen); and 3,369,834 (Miles).

SUMMARY OF THE INVENTION

In accordance with the invention, a pneumatically-activated, operator-held soil removal tool or device is provided which is, as noted above, particularly adapted for use in removing radioactively contaminated soil from outside of a containment so that the operator is protected, although the tool or device is also of general application in excavating operations. The device of the invention overcomes the disadvantages of the prior art tools discussed above that have been used for this purpose and is substantially easier to operate than such prior art devices.

In accordance with a preferred embodiment of the invention, an operator-held soil removal tool is provided adapted for removing soil, rock and like debris from the bottom of an excavation, while the operator is located outside of a containment for the excavation, the soil removal tool comprising: an elongate pipe member having a central bore therein; a fixed jaw affixed to one end of the pipe member; a movable jaw member; linkage means for mounting the movable jaw member on the pipe member so as that the movable jaw member is movable between an open position wherein the movable jaw member is spaced from the fixed jaw member and a closed position wherein the movable jaw member is closed against the fixed jaw member to form a cavity wherein soil can be captured; a handle connected to the pipe member including an air passage therein connected to the central bore of the pipe member; an air control valve located in the handle for controlling the flow of air through the air passage in the handle and thus through the bore in the pipe member; and an air-actuated, spring-returned pneumatic cylinder mounted on the pipe member and connected to the bore of the pipe member so as to receive air supplied thereto from the air passage to thereby provide actuation of the pneumatic cylinder, the pneumatic cylinder including an actuator member connected to the linkage means for, when the pneumatic cylinder is actuated, causing movement of the moveable jaw member to the closed position thereof and for, when the pneumatic cylinder is de-actuated, causing return of the movable jaw to the open position thereof.

Preferably, the linkage means includes a collar connected to the actuator member and slidably movable along the pipe member. The linkage means advantageously further comprises a link member connected between the collar and the movable jaw member. In addition, the linkage means preferably includes a further link member connected between the pipe member and the movable jaw member, the further link member advantageously being curved.

According to a further important feature of the invention, the pipe member comprises a plurality of removable sections so as to permit the length of the pipe member to be varied.

Other features and advantages of the invention will be set forth in, or apparent from, the following detailed description of a preferred embodiment of the invention.

DESCRIPTION OF THE PREFERRED EMBODIMENT

Figure 1:
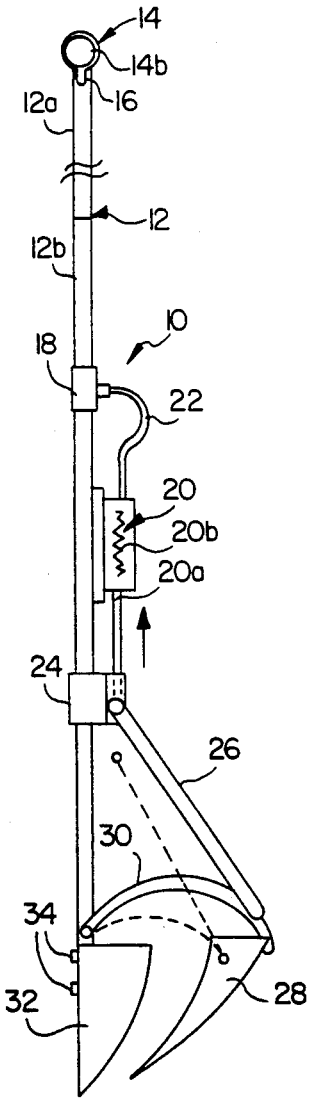
FIG. 1 is a side elevation view of a preferred embodiment of the soil removal tool of the invention, showing the tool in the open state thereof and with the control linkage being shown in the closed state in dashed lines.
Figure 2:
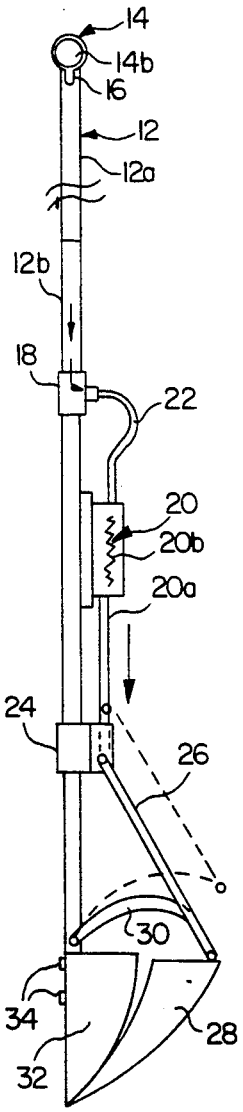
FIG. 2 is a side elevational view similar to FIG. 1 showing the tool in the closed state thereof, with the control linkage shown in the open state in dashed lines.
Figure 3:
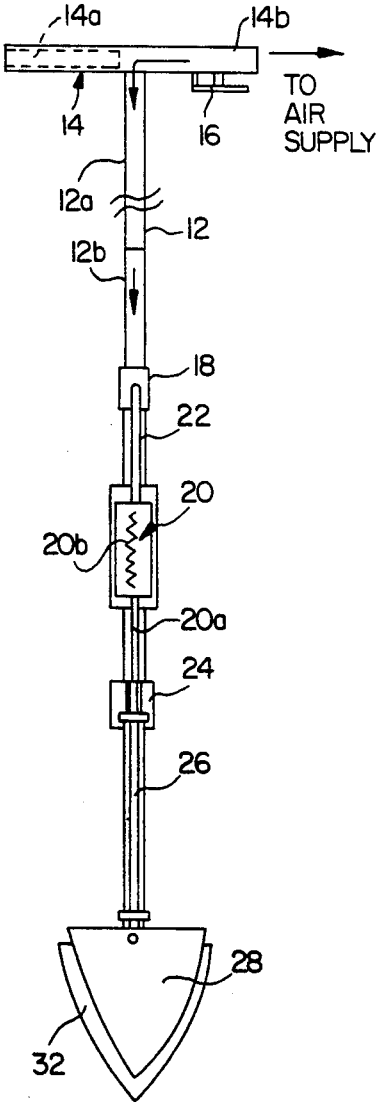
FIG. 3 is a front elevational view of the device of FIG. 1.

Referring to FIGS. 1, 2 which illustrate two different operational stages, and to FIG. 3, a preferred embodiment of the soil removal tool of the invention is shown. The tool, which is generally denoted 10, includes a pipe member or section 12 which, as explained below, serves as a non-movable jaw support. A transversely extending pipe handle 14 is provided at the top of pipe member 12, which is plugged at one end, denoted **14*a*, and which is adapted at the other end denoted 14*b*, to be connected to a supply of air so that end 14*b* forms an air inlet. Pipe member 12 can be of any required length and is preferably formed of a series of sections, as indicated by sections 12*a* and 12*b*, which are screwed together end-to-end, with additional sections being added in order to extend the overall length of the device as the depth of the excavation increases. A control valve and actuator 16 is provided in handle 14 to control the supply of air to pipe member 12. A pipe tee 18 is connected to pipe member 12, one leg of which is plugged and the transverse leg is connected to an air actuated, spring-returned pneumatic cylinder 20 mounted on pipe member 12. This connector is made through a connecting bore 22 so air supplied to the air inlet 14*b*, formed by handle 14 is supplied to pneumatic cylinder 20 under the control of valve actuator 16. A return spring for pneumatic cylinder 20 is indicated schematically at 20***b*.

Pneumatic cylinder 20 includes an actuator rod 20*a* which is connected to a collar 24 mounted on pipe member 12 so as to be slidable therealong. Collar 24 is connected through a movable bar or link 26 to a movable jaw 28. Jaw 28 is also connected to pipe member 12 through a curved pivotable bar or link 30.

A fixed jaw 32, secured to the bottom end of pipe 12 by bolt 34, cooperates with movable jaw 28 to provide the desired digging and soil removal operation.

Considering the operation of the tool of the invention, as described above, the tool 10 has the capability of extending through a containment to remove soil, rock and debris from the bottom of an excavation while the operator is located outside of the containment. The digging action is provided by the movable jaw 28 under the control of pneumatic cylinder 20 which, as noted above, is, in turn, controlled by air control valve 16 located on handle 14. More specifically, when the operator actuates air control valve 16, the movable jaw 28 is caused to move from the open position shown in FIG. 1 in solid lines (and which is indicated schematically in FIG. 2 in dashed lines) to the closed position thereof shown in solid line in FIG. 2. This movement is produced by extension of actuator rod 20*a* which causes collar 24 to slide along pipe member 12 thereby providing pivoting of jaw 28 to the closed position thereof through action of connecting bars or links 26 and 30. With movable jaw 28 closed against non-movable jaw 32, soil or other material to be removed is captured within the cavity formed by the jaws 28 and 32. The entire tool 10 can then be lifted out and moved to another site or location and by releasing the air valve 16, the load of material can be dumped. It will be appreciated that the spring 20*b* of pneumatic cylinder 20 causes automatic retraction of actuator rod 20*a* thus causing movement of jaw 28, to the open position shown in FIG. 1 and thus permits jaw 28 to be opened by simply releasing the air control valve 16.

Although the present invention has been described relative to a specific exemplary embodiment thereof, it will be understood by those skilled in the art that variations and modifications can be effected in this exemplary embodiment without departing from the scope and spirit of the invention.

What is claimed is:

1. An operator-held soil removal tool adapted for removing soil, rock, and like debris from the bottom of an excavation, said soil removal tool comprising:

an elongate pipe member having a central bore therein;

a fixed jaw affixed to one end of said pipe member and substantially collinear therewith;

a movable jaw member;

linkage means for mounting said movable jaw member on said pipe member so as that said movable jaw member is movable between an open position wherein said movable jaw member is spaced from said fixed jaw member and a closed position wherein said movable jaw member is closed against said fixed jaw member to form a cavity wherein soil can be captured;

a handle connected to said pipe member including an air passage therein connected to the central bore of the pipe member;

an air control valve located in said handle for controlling the flow of air through the air passage in said handle and thus through the bore in said pipe member;

and an air-actuated, spring-returned pneumatic cylinder mounted on said pipe member and connected to said pneumatic cylinder, said pneumatic cylinder including an actuator member connected to said linkage means for, when said pneumatic cylinder is actuated, causing movement of said movable jaw member to the closed position thereof and for, when the pneumatic cylinder is de-actuated, causing return of the movable jaw to the open position thereof, wherein said linkage means includes a collar connected to said actuator member and slidably movable along said pipe member.

2. A soil removal tool as claimed in claim 1 wherein said linkage means further comprises a link member connected between said collar and said movable jaw member.

3. A soil removal tool as claimed in claim 2 wherein said linkage means includes a further link member connected between said pipe member and said movable jaw member.

4. A soil removal tool as claimed in claim 3 wherein said further link member is curved.

5. A soil removal tool as claimed in claim 1 wherein said pipe member comprises a plurality of removable sections so as to permit the length of said pipe member to be varied.

* * * * *